US008185986B2

(12) United States Patent
Grimes et al.

(10) Patent No.: US 8,185,986 B2
(45) Date of Patent: May 29, 2012

(54) ADJUSTABLE BED BASE HAVING VIBRATING MOTOR IN POCKET

(75) Inventors: Jimmy L. Grimes, Carthage, MO (US); Jacob J. Neuenswander, Carthage, MO (US); William R. Rohr, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 457 days.

(21) Appl. No.: 12/502,650

(22) Filed: Jul. 14, 2009

(65) Prior Publication Data

US 2011/0010860 A1 Jan. 20, 2011

(51) Int. Cl.

| | |
|---|---|
| ***A47B 71/00*** | (2006.01) |
| *A47B 7/02* | (2006.01) |
| *A47B 7/00* | (2006.01) |

(52) U.S. Cl. ..... 5/600; 5/933; 5/616; 5/613; 5/915

(58) Field of Classification Search ..... 5/600, 613, 5/617, 616, 618, 639, 694, 485, 915, 933, 5/934, 674

See application file for complete search history.

(56) References Cited

U.S. PATENT DOCUMENTS

| | | | | |
|---|---|---|---|---|
| 2,539,712 | A * | 1/1951 | Wettlaufer | 601/57 |
| 2,833,276 | A | 5/1958 | Murphy | |
| 3,580,245 | A | 5/1971 | Dill | |
| 3,799,154 | A | 3/1974 | Knop | |
| 5,007,410 | A * | 4/1991 | DeLaney | 601/53 |
| 5,016,616 | A | 5/1991 | Hu | |
| 6,110,131 | A | 8/2000 | Sleichter, III et al. | |
| 6,684,423 | B2 * | 2/2004 | Godette | 5/600 |
| 7,039,970 | B1 | 5/2006 | Long | |
| 7,322,058 | B2 | 1/2008 | Long | |

* cited by examiner

*Primary Examiner* — Jonathan Liu

(74) *Attorney, Agent, or Firm* — Wood, Herron & Evans, LLP

(57) ABSTRACT

An adjustable bed (10) includes an adjustable bed base (12) for supporting a mattress (14). The adjustable bed base (12) comprises an articulated deck (50) comprising head, seat, leg and foot deck boards (54, 56, 58, 58) hingedly joined together and supported from a frame (32). At least one of the support sections has an opening (72, 74) and a pocket (86) secured underneath the opening. Inside the pocket (86) is located a vibratory motor (100), the vibratory motor (100) being electrically coupled to a powered drive unit (66) for vibrating a portion of the adjustable bed (10).

20 Claims, 7 Drawing Sheets

ADJUSTABLE BED BASE HAVING VIBRATING MOTOR IN POCKET

FIELD OF THE INVENTION

This invention relates generally to adjustable beds and, more particularly, to an adjustable bed base for use with a mattress.

BACKGROUND OF THE INVENTION

Adjustable beds have been used for many years to permit the user to adjust the head and foot sections of the bed to different positions. While originally only manually adjustable, more recently, the head and foot sections are moved or adjusted by motors operated by the user via a remote control.

Adjustable beds were originally designed principally for use in medical environments by patients who had to spend long periods of time in bed for reasons of health, injury, etc. However, more recently, adjustable beds are also being used in residential environments by users who have no health or physical impairment. An increasing number of people place televisions and other entertainment devices in the bedroom, and more time is spent lounging in bed. Hence, the bed, and in particular, an adjustable bed, is considered by many users an alternative piece of leisure furniture. As the market for leisure beds grows, there is continuing effort by suppliers to provide leisure beds that are more comfortable, have more options, for example, massage capabilities, more sophisticated controls, and are more affordable.

One recent development in adjustable beds is the development of a "wallhugger" adjustable bed. The wallhugger adjustable bed maintains the user in the same position with respect to adjacent appliances and furniture as the head portion of the bed is moved between flat and elevated positions. To achieve that purpose, as the head section pivots upward, an upper bed frame portion translates toward the head end of the bed with respect to a stationary lower bed frame section.

Almost all adjustable beds utilize one or more massage motors which are controllable by a user to provide a massaging action while the user is in the bed. In some adjustable beds, a massage motor is rigidly connected to an underside of a rigid platform, for example, a headboard or a footboard, that is hinged to a centerboard or platform. Further, the whole articulated platform normally supports a mattress base, for example, a foam pad approximately four inches thick over which is placed beneath a mattress. Thus, any vibration applied to the underside of the headboard must vibrate the whole headboard; and further, the vibration is partially absorbed and attenuated by the soft materials in the mattress base and the mattress. The resulting or net vibration applied to a user lying on the mattress is often substantially less than is desired. In other designs, the massage motor is rigidly mounted to a resonator board that is inserted into a centrally located slit and cutout portion of the mattress base. The resonator board is then bonded to an interior surface within the slit in the mattress base, and the massage motor extends downward through the cutout in the mattress base and a contiguous cutout in the platform supporting the mattress base and the mattress. As with the former design, the vibrating action of the massage motor is substantially attenuated by the thick foam mattress base.

U.S. Pat. Nos. 7,039,970 and 7,322,058 disclose adjustable beds having an articulated deck having at least one hole for mounting a massage or vibratory motor. Each of the massage motor mounting mechanisms described in these patents uses a mounting plate located between a mattress pad and a mattress. The mounting plate is secured to the massage motor using fasteners. Such vibratory mounting mechanisms may be louder than desired for some individuals.

Thus, there is a need for an improved adjustable bed structure for more quietly transmitting massaging actions or vibrations from a massage motor to a user lying on the adjustable bed.

SUMMARY OF THE INVENTION

This invention comprises an adjustable bed having an adjustable or articulated deck comprising multiple support sections for supporting a mattress. The adjustable bed may be powered by a drive unit utilizing two motors or an electric motor driven linear actuator assembly. However, any other drive assembly, such as a conventional electrical motor driven screw and nut actuator system may be used in accordance with the present invention.

According to one aspect of this invention, the adjustable bed comprises an adjustable bed base for supporting a mattress above the adjustable bed base. The adjustable bed may include cushioning material such as a mattress pad of foam or fiber or a pocketed spring assembly overlaying an articulated mattress support platform of the adjustable bed base.

The adjustable bed base comprises a bed frame and an articulated mattress support platform comprising multiple support sections supported by the bed frame, at least one of the support sections having an opening. The adjustable bed base further comprises a pocket secured to a lower surface of the at least one of the support sections underneath the opening. The pocket comprises first and second opposing panels, each of the panels being secured to one another, thereby forming a cavity. In one embodiment, each panel is made of polyester fill material with a cover made of non-woven polyester fabric. Any other suitable sound absorption material may be used for the panels such as foam or fiber which may be arranged in any desired layering pattern.

The adjustable bed base further comprises a vibratory or massage motor positioned in the cavity of the pocket, the vibratory motor being electrically coupled to a powered drive unit of the adjustable bed base. The first and second opposing panels of the pocket have respective first and second peripheral edges wherein at least a portion of the first and second peripheral edges are secured to one another to form the cavity with an access opening for inserting and/or removing the massage or vibratory motor. Across the access opening the first and second peripheral edges of the pocket are separate with an electrical wire extending from the vibratory motor passing through the access opening. In one embodiment, the first and second opposing panels of the pocket are further joined to each other, as by sewn lines of attachment, for example, to form a sub-pocket, the vibratory motor residing in the sub-pocket. The pocket is stapled or otherwise secured to one of the mattress support sections below an opening in the mattress support section.

The adjustable bed base further comprises a support strap for supporting the vibratory motor. In one embodiment, the support strap has one end portion secured to the pocket. The opposite end of the strap is stapled or otherwise secured to one of the support sections of the articulated mattress support platform. When the pocket is stapled or otherwise secured to the articulated mattress support platform below an opening, both ends of the strap may be secured via staples or any other means to the articulated mattress support platform. The strap may be made of an elastic material such as nylon or any other suitable material, thereby reducing vibration transfer between the vibratory motor and the support section of the articulated mattress support platform.

According to one aspect of this invention, the adjustable bed base comprises a bed frame and an articulated mattress support platform comprising multiple support sections supported by the bed frame, at least two of the support sections each having an opening. The adjustable bed base further comprises a pocket secured to each of the support sections having an opening generally underneath the opening. The pocket comprises first and second opposing panels, the first and second panels being secured to one another thereby forming a cavity. The adjustable bed base further comprises a vibratory motor positioned in the cavity, the vibratory motor being electrically coupled to a powered drive unit of the adjustable bed base.

According to another aspect of this invention, a method of making an adjustable bed comprises providing an adjustable bed base having an articulated mattress support platform comprising multiple support sections. The next step comprises securing a pocket to one of the mattress support sections, the pocket comprising first and second rectangular panels sewn together and defining a cavity within the pocket. The last steps comprise inserting a vibratory motor into the pocket and electrically coupling the vibratory motor to a drive unit of the adjustable bed base.

DETAILED DESCRIPTION OF THE DRAWINGS

Figure 1:
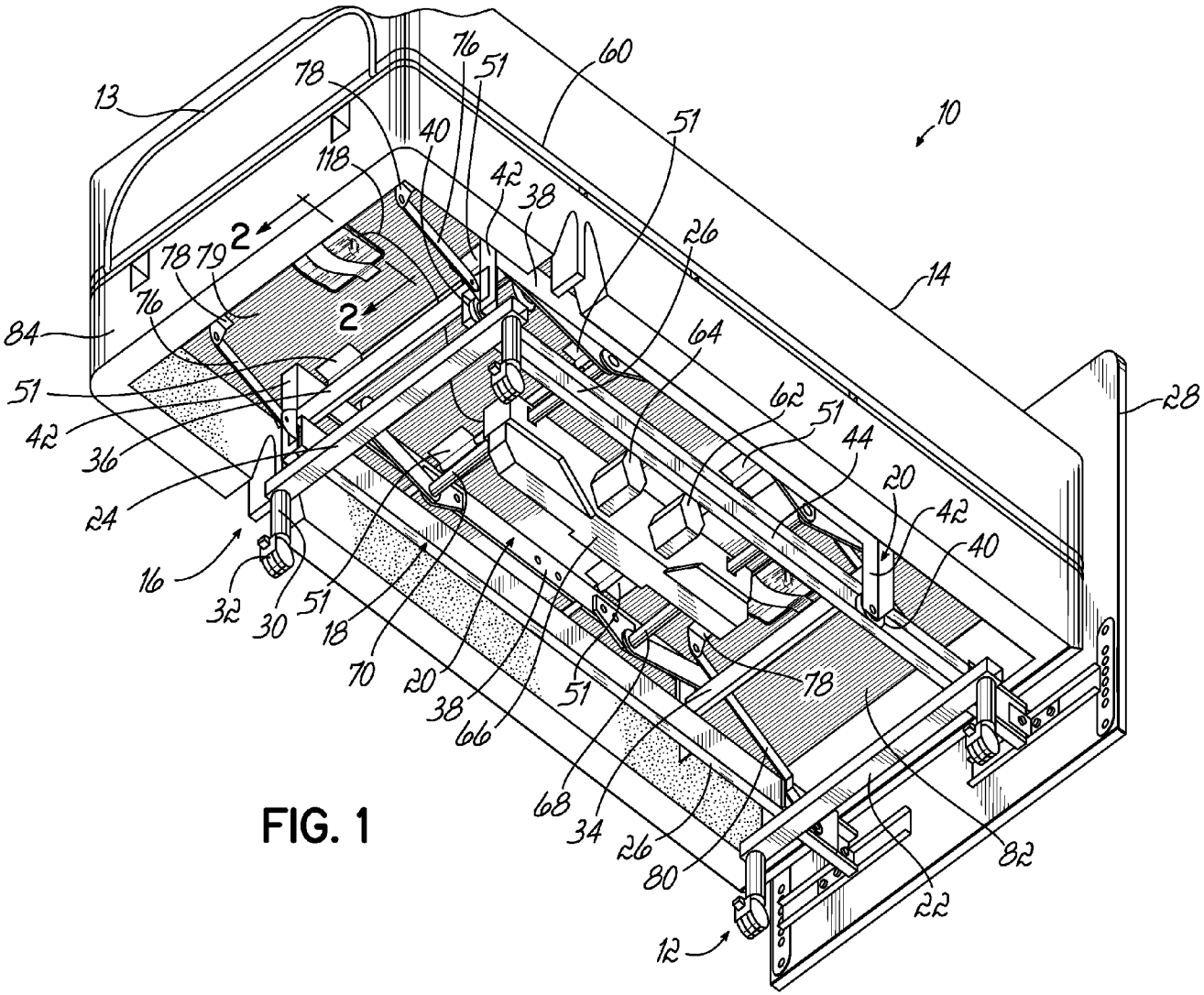
FIG. 1 is a perspective view of an adjustable bed in a horizontal position with associated mattress components in accordance with the present invention.

Referring to the drawings, and particularly to FIG. 1, there is illustrated an adjustable bed 10 comprising an adjustable bed base 12 supporting a mattress 14. The adjustable bed 10 may be used to support any type of mattress including an air mattress, a coil spring mattress or any other type of mattress. The adjustable bed base 12 includes a generally U-shaped stop 13 at the foot end of the adjustable bed 10 to prevent the mattress 14 from moving rearwardly.

The adjustable bed base 12 comprises a bed frame 16 having a stationary lower frame 18 and a movable upper frame 20 movably mounted on the lower frame 18. The lower frame 18 has head and foot end rails 22, 24, respectively and left and right side rails 26. The rails 22, 24 and 26 are joined at their ends to form the generally rectangular lower frame 18. The lower frame 18 at the head end is joined to a head board 28. A plurality of caster brackets 30 are secured to and extend down from the end rails 22, 24 of the lower frame 18. A plurality of casters 32, each having a stem (not shown) are received inside the caster brackets 30 for supporting the adjustable bed 10 on the floor and enabling the adjustable bed 10 to be rolled from location to location.

The upper frame 20 includes a head rail 34, a foot rail 36 and left and right side rails 38. The rails 34, 36 and 38 are rigidly connected at their ends with fasteners to form the generally rectangular movable upper frame 20. The upper frame side rails 38 are made of angle stock, and the upper frame 20 is movably mounted on the lower frame 18 by four wheels 40 (only two being shown in FIG. 1) which are rotatably mounted to the ends of legs 42. The wheels 40 ride in C-shaped channels or tracks 44 forming the left and right side rails 26 of the stationary lower frame 18.

Figure 3:
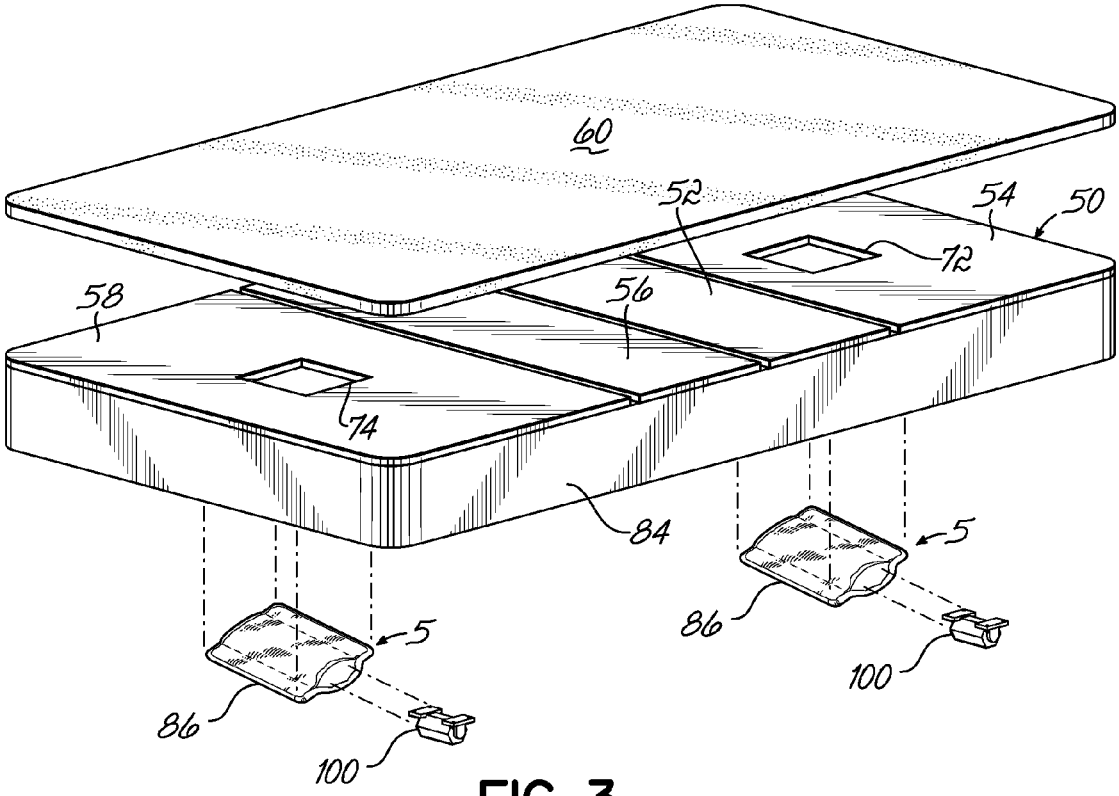
FIG. 3 is a partially disassembled view of a portion of the adjustable bed of FIG. 1 with the adjustable bed base in a horizontal position.

As best illustrated in FIG. 3, an articulated deck or mattress support platform 50 comprises a first or seat deck board or section 52 connected to the upper frame 20 and a head deck board or section 54 is pivotally connected to a head end of the seat deck board or section 52 with hinges 51 (see FIG. 1). A leg deck board or section 56 is pivotally connected to a foot end of the seat deck board or section 52 with hinges 51; and a foot deck board or section 58 is pivotally connected to a foot end of the leg deck board or section 56 with hinges 51. Each of the deck boards is preferably the same width but any two deck boards may be different widths, if desired. Although, two hinges are shown securing adjacent deck sections, any number of hinges may be used including one continuous hinge. The mattress supporting sections may be made from any desired material that is capable of properly supporting a user on a mattress, for example, a plywood or oriented strand board (OSB) material.

Figure 2:
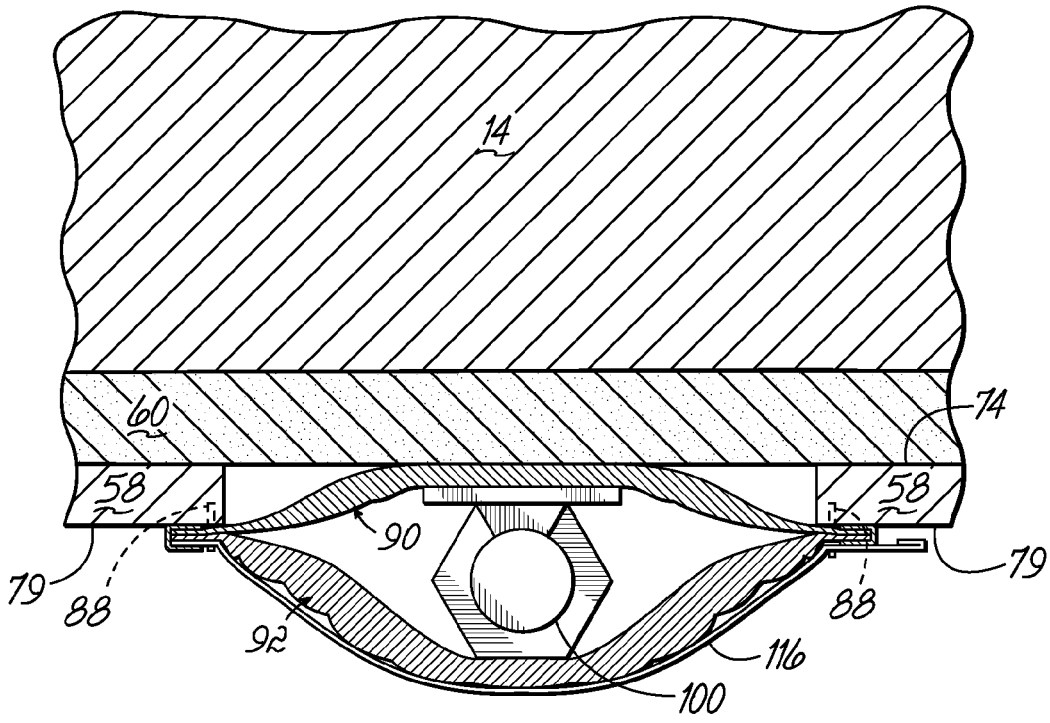
FIG. 2 is a partial cross-sectional view taken along the line 2-2 of FIG. 1 and illustrates a vibratory motor located in accordance with the present invention.

Cushioning material such as a mattress pad 60 is mounted over and covers the articulated deck or mattress support platform 50. Normally, the articulated deck or mattress support platform 50 and mattress pad 60 are enclosed within a covering (not shown). As shown in FIGS. 1 and 2, a mattress 14 is then laid over the mattress pad 60.

As shown in FIG. 1, head and leg motors 62, 64, respectively, are mounted to a powered drive assembly or unit 66 which mechanically couples the head and leg motors 62, 64 to respective head and leg torque tubes 68, 70, in a known manner. Operating the head motor 62 rotates the torque tube 68 and raises the head section 54 of the articulated deck or mattress support platform 50. With the adjustable bed of FIG. 1, as the head section 54 is raised, the upper frame 24 moves or translates towards the head end of the bed; and the head section 54 remains close to the headboard 28. Operating the leg motor 64 rotates the leg torque tube 70 and raises the junction of the leg and foot sections 56, 58, respectively. This type of adjustable bed is known in the industry as a Wallhugger® bed. However, the present invention may be used with any adjustable bed or adjustable bed base having any type of frame including a stationary frame.

As illustrated in FIG. 3, the head deck board 54 has a rectangular hole 72 therein. Similarly, the foot deck board 58 has a rectangular hole 74 therein. Either one or both of these holes or openings may be used to mount a massage unit 5 as described below.

The adjustable bed 10 further comprises two foot links 76 or connectors, of the same length. Each of the foot links 76 is pivotally secured at a lower end to the movable upper frame 20 so that each pivots about a horizontal pivot axis. Each foot link 76 is pivotally secured at its upper end to a bracket 78 fixed to the lower surface 79 of the foot deck board 58.

The adjustable bed 10 further comprises two head links 80 or connectors, of the same length. Each of the head links 80 is pivotally secured at a lower end to the movable upper frame 20 so that each pivots about a horizontal pivot axis. Each head link 80 is pivotally secured at its upper end to a bracket 78 fixed to the lower surface 82 of the head deck board 54.

As best illustrated in FIG. 1, the adjustable bed 10 further comprises a lower border 84 generally rectangular in shape and secured to the lower surface of the articulated deck 50. This lower border 84 may comprise one piece or multiple pieces of foam, fiber or wood or any other suitable material. One purpose of the lower border 84 is to provide an attractive appearance when an upholstered covering (not shown) is put over the adjustable bed 10.

Figure 4:
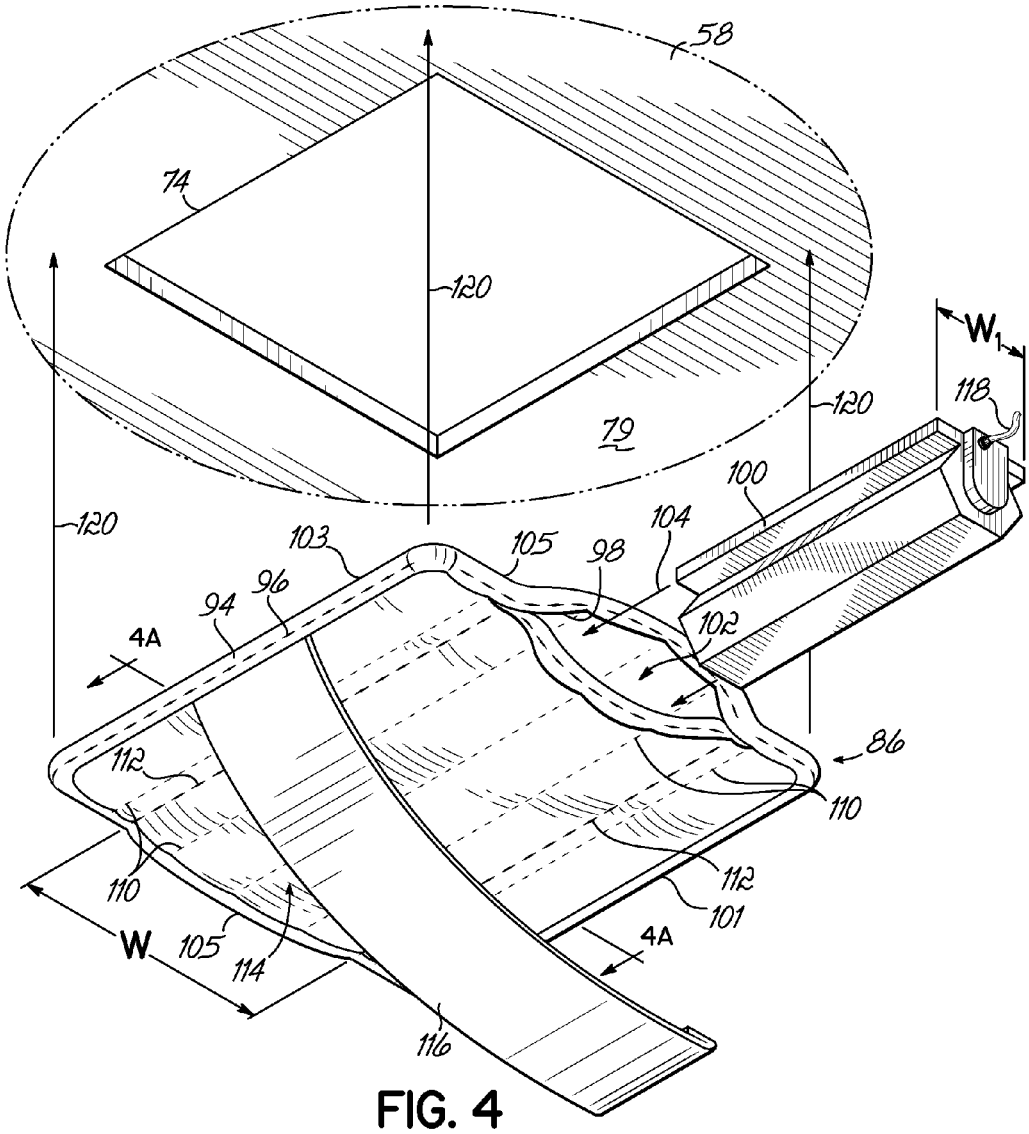
FIG. 4 is a bottom perspective view of a portion of the adjustable bed of FIG. 1 showing the fabric pocket being secured to an underside of one of the support sections of the articulated mattress support platform.
Figure 4A:
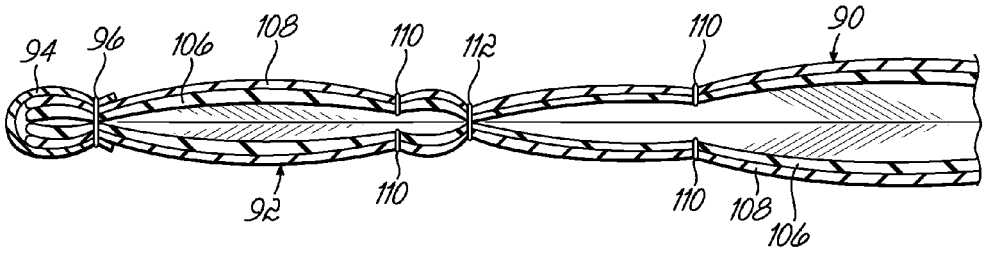
FIG. 4A is a partial cross-sectional view taken along the line 4A-4A of FIG. 4.

As shown in FIGS. 2 and 4, the adjustable bed base 12 further comprises a pocket 86 secured to the foot deck board 58 and more particularly, to the lower surface 79 of the foot deck board 58 with staples 88. The pocket 86 comprises a first or upper rectangular panel 90 and a second or lower rectangular panel 92 of the same size. As shown in FIGS. 4 and 4A, the panels 90, 92 are secured to each other around a portion of the periphery of the aligned panels 90, 92. More particularly, tape edge material 94 is wrapped around the aligned edges of the panels 90, 92 before being sewn. The two panels 90, 92 and the tape 94 are sewn together along a sew line 96 which does not extend around the entire periphery of the panels 90, 92 but only partially around the periphery of the panels 90, 92. As shown in FIG. 4, an access opening 98 is left in the pocket 86 to allow a vibratory or massage motor 100 to be inserted into a cavity 102 of the pocket 86 during assembly of the adjustable bed base 12. See arrows 104. The pocket has a front edge 101, a rear edge 103 and two opposed side edges 105, the access opening 98 being located along one of the side edges 105 of the pocket 86.

In one embodiment, each panel 90, 92 comprises an interior layer 106 of polyester fibers and a exterior cover of non-woven polyester fabric 108 sewn together along sewn lines 110 which extend transversely or from side-to-side, as shown in FIGS. 4 and 4A. Alternatively, any number of layers including foam or fiber or any sound absorbing material may be incorporated into one or the other or both panels 90, 92.

In the illustrated embodiment, the panels 90, 92 are further sewn together with two parallel sewn lines 112 extending parallel to the sewn lines 110 of each panel. These two sewn lines 112 define a sub-pocket 114 having a width W slightly greater than the width W1 of the vibratory motor 100. Therefore, the vibratory motor 100 may remain oriented from side-to-side relative to the adjustable bed base 12 inside the sub-pocket 114. In an alternative embodiment, the two sewn lines 112 define a sub-pocket 114 may be omitted, in which case, the vibratory motor 100 would reside inside the cavity 102 of the pocket 86.

In the embodiment illustrated in FIG. 4, a strap 116 is sewn to the rear edge 103 of pocket 86 and has a length greater than the width of the pocket 86. In one embodiment, the strap 116 is made of woven polypropylene and natural rubber and sold by Matrex®, a division of Leggett & Platt, Incorporated under the name "180 Greenline". However, the support strap may be made of any desired material.

Figure 5:
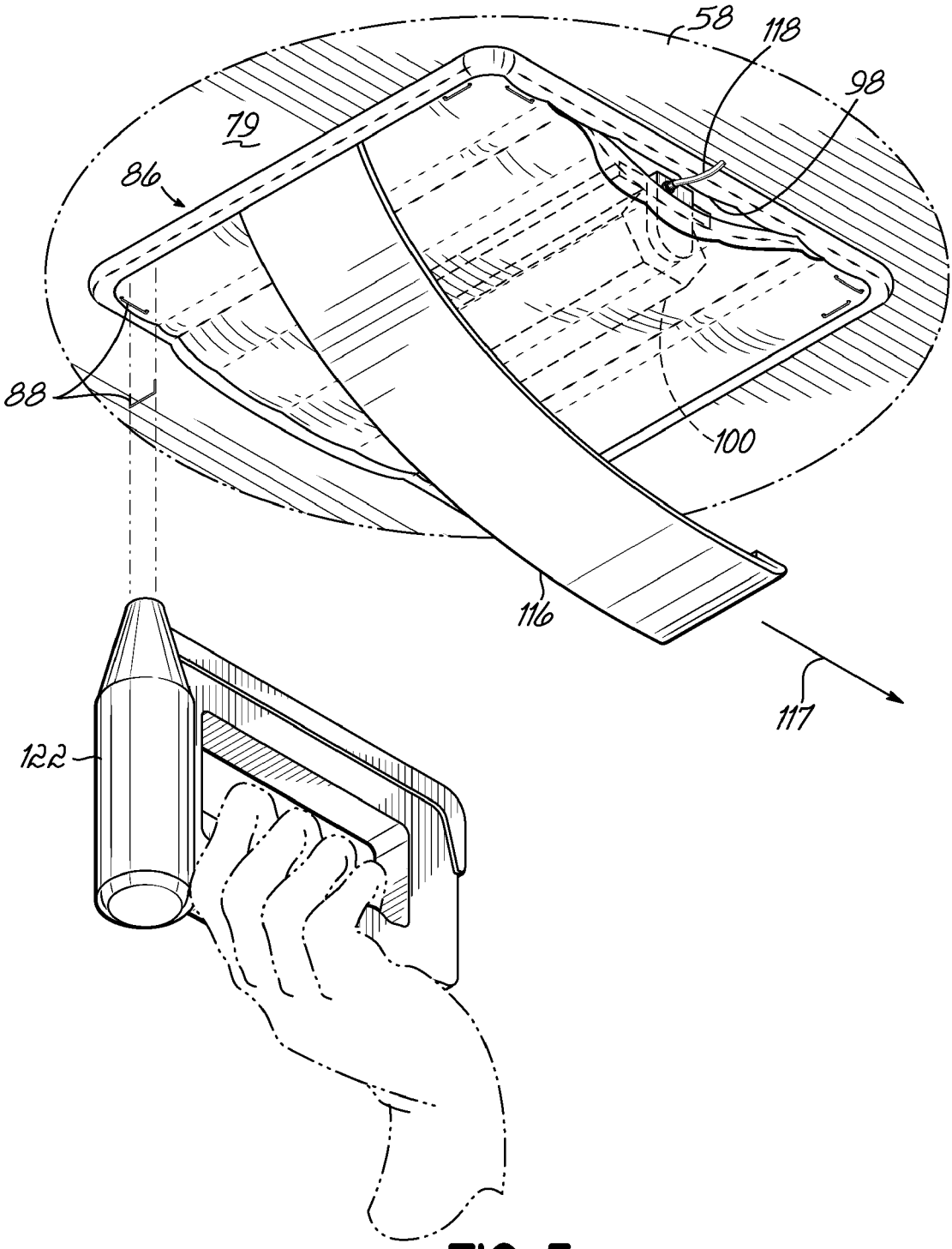
FIG. 5 is a bottom perspective view showing the fabric pocket of FIG. 4 being stapled in its proper location.
Figure 6:
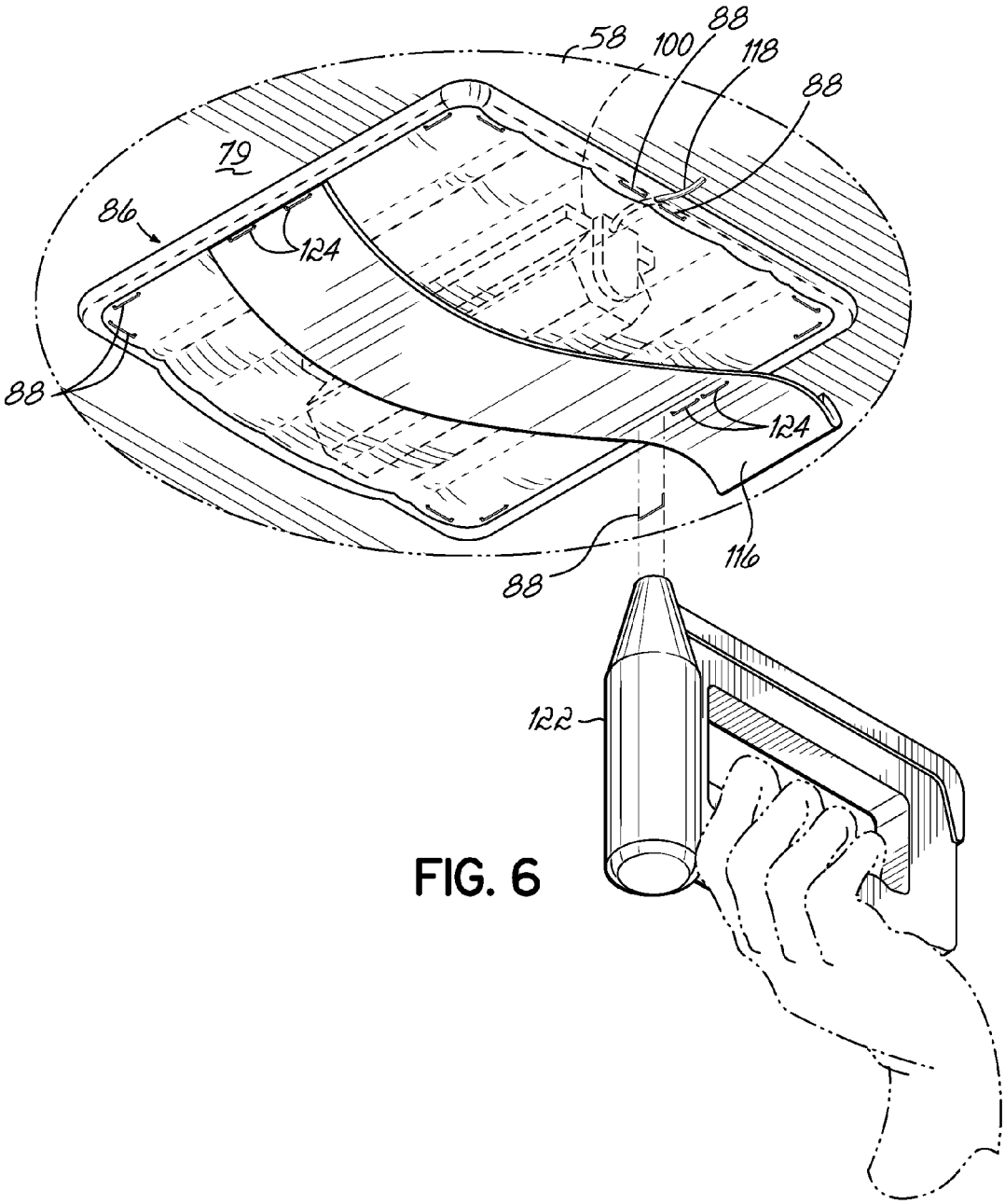
FIG. 6 is a bottom perspective view showing the fabric pocket of FIG. 4 being further stapled in its proper location.

FIGS. 4, 5 and 6 illustrate how the pocket 86 is secured to the adjustable bed base 12. As illustrated in FIG. 4, the vibratory motor 100 is placed inside the sub-pocket 114 or cavity 102 with a wire 118 extending outwardly from the vibratory motor 100 and through the access opening of the pocket 86. The pocket 86 with the vibratory motor 100 inside its cavity is then raised in the direction of arrows 120 from a position underneath opening 74 in the foot support section 58 of the articulated deck 50.

As shown in FIG. 5, the corners of the pocket 86 with the vibratory motor 100 therein are stapled to the foot support section 58 of the articulated deck 50 with a staple gun 122. Staples 88 secure the corners of the filled pocket 86 in place and are inserted on each side of the wire 118 extending outwardly from the vibratory motor 100 as shown in FIG. 6. These staples 88 close the access opening 98 of the pocket 86 to prevent the vibratory motor 100 from falling out or moving from inside the sub-pocket 114 or cavity 102 of the pocket 86.

As shown in FIG. 6, additional staples 124 are used to secure one end of the strap 116 (shown on the left of FIG. 6) and the pocket 86 to the foot support section 58 of the articulated deck 50 with a staple gun 122. After the filled pocket 86 and one end of the strap 116 are secured, i.e. stapled, to the articulated deck 50, the strap 116 is pulled taught in the direction of arrow 117 to raise the vibratory motor 100 inside the opening 74 in the foot support section 58 of the articulated deck 50. These staples 124 and strap 116 further support the vibratory motor 100 inside the cavity 102 of the pocket 86 and actually raise the position of the vibratory motor 100 relative to the articulated deck 50 of the adjustable bed base 12. Lastly, the staple gun 122 is used to staple the pocket 86 and the other end of the strap 116 to the foot support section 58 of the articulated deck 50 with additional staples 124.

Figure 7:
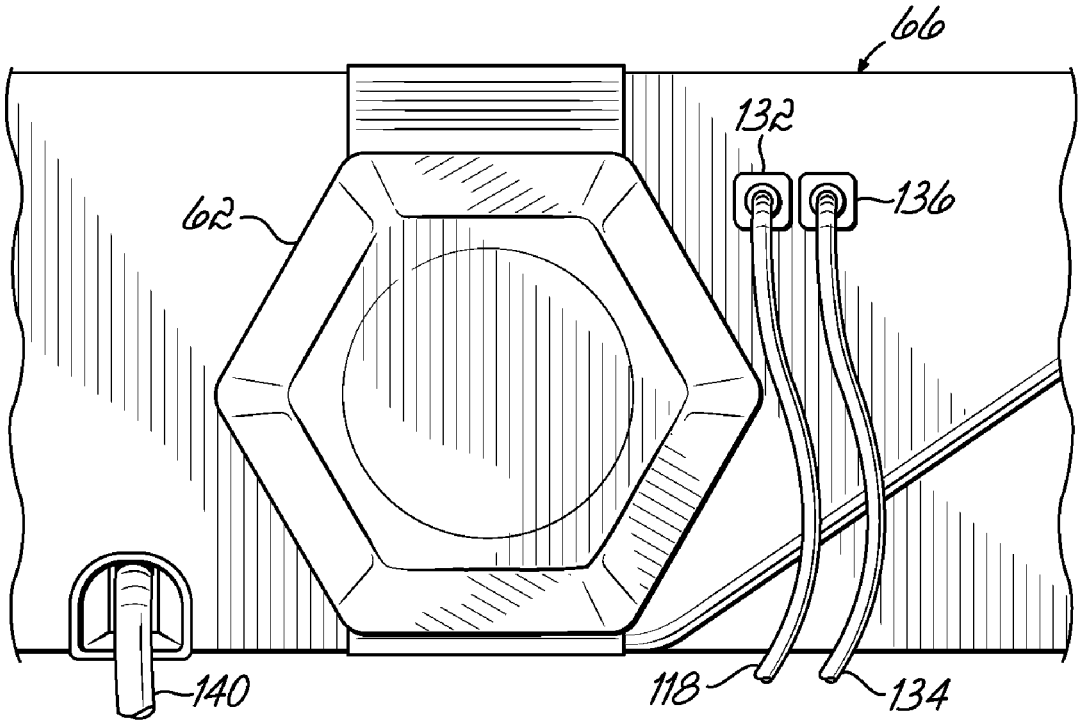
FIG. 7 is a side elevational view of a portion of the powered drive assembly or unit of the adjustable bed shown in FIG. 1.

As illustrated in FIGS. 1 and 7, the wire 118 extends from the vibratory motor 100 at one end to the powered drive assembly or unit 66 at the other end. FIGS. 1 and 3 also show another pocket 86 adapted to be secured underneath opening 72 and having a vibratory motor 100 to be secured therein. This vibratory motor 100 is similarly electrically coupled via wire 134 to the powered drive assembly or unit 66 as shown in FIG. 7.

Figure 2A:
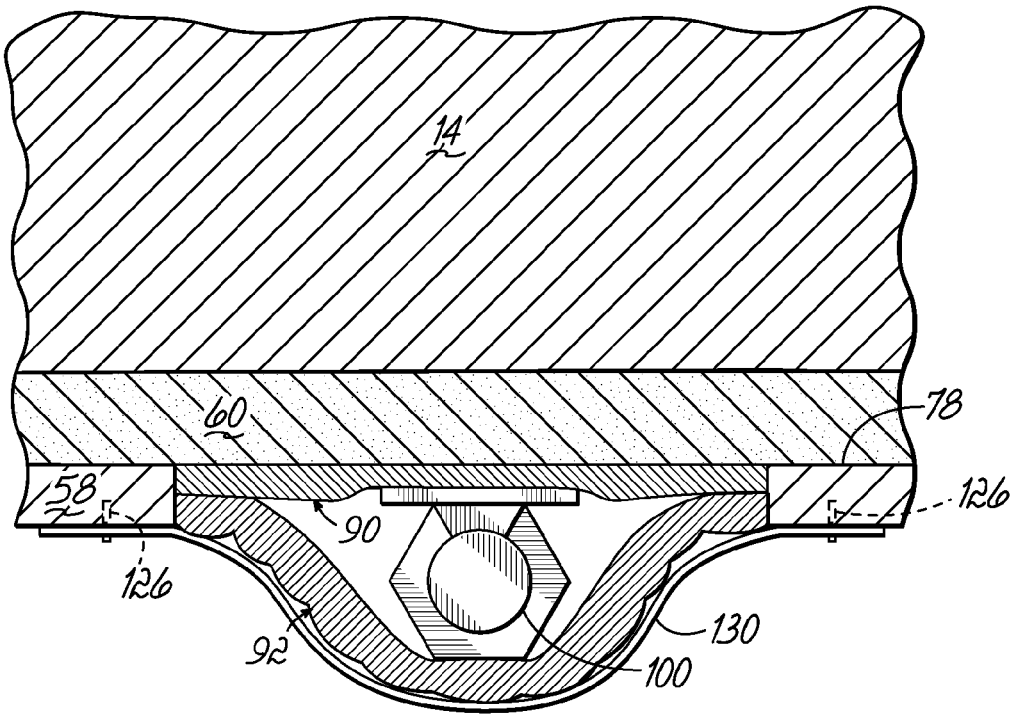
FIG. 2A is a partial cross-sectional view like FIG. 2 of an alternative embodiment of the present invention.

FIG. 2A illustrates an alternative embodiment in which a strap 130 is not secured or sewn to the pocket 86 but instead is a piece of material which is stapled or otherwise secured to the lower surface 79 of the foot deck board 58 with staples 126.

FIG. 7 is an enlarged view of a portion of the powered drive assembly or unit 66 showing the wire 118 which extends outwardly from the vibratory motor 100 and has a plug 132 which electrically plugs into the powered drive assembly or unit 66. Similarly, the vibratory motor 100 underneath opening 72 in the head section 54 of the articulated deck 50 located in a pocket 86 has a wire 134 which extends outwardly from the vibratory motor 100 and has a plug 136 which electrically plugs into the powered drive assembly or unit 66. The powered drive assembly or unit 66 has a power cord 140 which plugs into a 120 volt AC power outlet, as is conventional in residential homes.

Although we have described several embodiments of the invention, we do not intend to be limited except by the scope of the following claims. For example, the support strap may be omitted.

We claim:

1. An adjustable bed base for supporting a mattress, said adjustable bed base comprising:

a bed frame;

an articulated mattress support platform comprising multiple support sections supported by the bed frame, at least one of the support sections having an opening;

a fabric pocket secured to a lower surface of said at least one of support sections, said pocket comprising first and second opposing panels, each of said first and second panels comprising multiple layers of material sewn together, said first and second panels being sewn to one another thereby forming a cavity; and a vibratory motor positioned in said cavity, said vibratory motor being electrically coupled to a powered drive unit.

2. The adjustable bed base of claim 1 wherein said first and second opposing panels have respective first and second peripheral edges, and wherein at least a portion of said first and said second peripheral edges are secured together to form said cavity.

3. The adjustable bed base of claim 1, each of said first and second panels being made of sound absorbing material.

4. The adjustable bed base of claim 1 wherein at least one of said panels has polyester fibers.

5. The adjustable bed base of claim 1 further comprising a support strap for further supporting the vibratory motor.

6. The adjustable bed base of claim 1 wherein said first and said second peripheral edges are separate across an access opening to said cavity with an electrical wire extending from said vibratory motor and through said access opening.

7. The adjustable bed base of claim 1 wherein said pocket has a sub-pocket, the vibratory motor residing in said sub-pocket.

8. The adjustable bed base of claim 7 wherein said first and second opposing panels are sewn to each other to form the sub-pocket.

9. The adjustable bed base of claim 1 wherein said pocket is stapled to said at least one of said mattress support sections.

10. The adjustable bed base of claim 1 wherein each of said first and said second panels comprises an interior layer of polyester fiber and an exterior made of non-woven polyester fabric.

11. The adjustable bed base of claim 1 wherein said first and second peripheral edges of said first and second panels are sewn together after being covered with mattress binding tape.

12. The adjustable bed base of claim 1 wherein said pocket further comprises a strap, one end of said strap being secured to said pocket.

13. The adjustable bed base of claim 12 wherein said strap is made of an elastic material thereby reducing vibration transfer between said vibratory motor and said one of said support sections.

14. An adjustable bed base for supporting a mattress, said adjustable bed base comprising:

a bed frame;

an articulated mattress support platform comprising multiple support sections supported by the bed frame, at least two of the support sections each having an opening;

a fabric pocket secured to each of said support sections having an opening, said pocket comprising first and second opposing panels, at least one of said panels comprising polyester fibers, said first and second panels being secured to one another thereby forming a cavity; and a vibratory motor positioned in said cavity, said vibratory motor being electrically coupled to a powered drive unit.

15. The adjustable bed of claim 14 further comprising a support strap for supporting the vibratory motor.

16. The adjustable bed of claim 15 wherein said first and second panels are sewn together.

17. The adjustable bed base of claim 15 wherein each of said first and said second panels comprises an interior layer of polyester fiber and an exterior made of nom woven polyester fabric.

18. The adjustable bed base of claim 15 wherein said strap is made of an elastic material thereby reducing vibration transfer between said vibratory motor and said one of said support sections.

19. An adjustable bed base for supporting a mattress, said adjustable bed base comprising:

a bed frame;

an articulated mattress support platform comprising multiple support sections supported by the bed frame, at least one of the support sections having an opening;

a fabric pocket secured to a lower surface of said at least one of support sections having an opening, said pocket comprising first and second panels, at least one of said first and second panels comprising multiple layers of material, said first and second panels being secured to one another thereby forming a cavity; and a vibratory motor positioned in said cavity, said vibratory motor being electrically coupled to a powered drive unit.

20. The adjustable bed of claim 19 further comprising a support strap for supporting the vibratory motor.

* * * * *